US005800321A

United States Patent [19]

Webber

[11] Patent Number: 5,800,321

[45] Date of Patent: Sep. 1, 1998

[54] EXERCISE APPARATUS WITH ADJUSTABLE LEVER ARM

[76] Inventor: Randall T. Webber, 11162 Morning Creek Dr. South, San Diego, Calif. 92128

[21] Appl. No.: 900,569

[22] Filed: Jul. 25, 1997

Related U.S. Application Data

[63] Continuation-in-part of Ser. No. 802,286, Feb. 20, 1997, abandoned, which is a continuation of Ser. No. 523,647, Sep. 5, 1995, abandoned, which is a continuation-in-part of Ser. No. 374,330, Jan. 18, 1995, abandoned.

[51] Int. Cl.[6] ..... A63B 21/16

[52] U.S. Cl. ..... 482/103; 482/100; 482/133; 482/137; 482/138

[58] Field of Search ..... 482/99–103, 133, 482/136–138, 95, 96, 142

[56] References Cited

U.S. PATENT DOCUMENTS

| | | | |
|---|---|---|---|
| 4,826,157 | 5/1989 | Fitzpatrick | 482/103 |
| 5,044,629 | 9/1991 | Ryan et al. | 482/101 |
| 5,429,569 | 7/1995 | Gunnari et al. | 482/103 |

FOREIGN PATENT DOCUMENTS

| | | | |
|---|---|---|---|
| 1586724 | 8/1990 | U.S.S.R. | 482/103 |
| 1743620 | 6/1992 | U.S.S.R. | 482/103 |

*Primary Examiner*—Richard J. Apley
*Assistant Examiner*—John Mulcahy
*Attorney, Agent, or Firm*—Brown, Martin, Haller & McClain, LLP

[57] ABSTRACT

An exercise apparatus having a support frame, an exercise resistance device such as a weight stack, and a linkage such as a cable and pulley linkage extending from the weight stack to various exercise stations, has a lever arm pivotally mounted on the frame for rotation about a first horizontal pivot axis into any one of a plurality of selected orientations relative to the frame, and a locking device for locking the lever arm in the desired orientation. A cable linked to the exercise resistance extends around a first pulley attached to the arm for rotation about a second horizontal axis spaced forwardly from the first and a second pulley at the end of the arm on the lever arm and has a connector at its free end for connecting the cable to a selected exercise device or to a tie-off point. Adjusting the orientation of the lever arm raises and lowers the point of connection to the exercise resistance or tie-off, and allows adjustment for different types of exercises.

16 Claims, 5 Drawing Sheets

EXERCISE APPARATUS WITH ADJUSTABLE LEVER ARM

CROSS-REFERENCES TO RELATED APPLICATIONS

This application is a Continuation-In-Part of application Ser. No. 08/802,286 filed on Feb. 20, 1997, (abandoned) which was a File Wrapper Continuation of application Ser. No. 08/523,647 filed Sep. 5, 1995 (abandoned), which was a Continuation-In-Part of application Ser. No. 08/374,330 filed Jan. 18, 1995 (abandoned).

BACKGROUND OF THE INVENTION

The present invention relates generally to an exercise apparatus or weight-lifting machine, and is particularly concerned with such machines having an adjustable lever arm linked to a cable system for exercising different muscle groups.

Some known exercise machines have adjustable lever arms, but have the disadvantage that adjustment of the lever arm will change the tension on the cable system.

Some weight machines have a low swivel which generally comprises a pulley journaled on an axle carried on brackets mounted on the base of a support frame of the machine. A cable linked to the weight stack extends around the pulley with a stop adjacent the end to prevent the cable from being pulled back through the pulley and a hook or other fastener at the end for selectively connecting the cable to an exercise device such as a crossbar handle for performing arm curls. Some low swivels have brackets which are pivotally mounted for swivelling about a vertical pivot axis so that the pulley and cable can be orientated as desired by the user.

One disadvantage of existing low swivels is that they are not adjustable for different height users, so that, with a very tall user standing upright, the weight stack may hit the top of the support frame before the user has extended their arms to the full extent if performing arm exercises, for example. Another disadvantage is that the cable stop will tend to ride around the pulley wheel when a user is performing standing position exercises. This produces a disagreeable feel to the user, and also results in a kink in the cable, producing increased wear on the cable at that point.

SUMMARY OF THE INVENTION

It is an object of the present invention to provide a new and improved lever arm arrangement for a multi-station exercise apparatus.

According to the present invention, an exercise apparatus is provided which comprises a support frame, a resistance device such as a weight stack mounted on the support frame, a lever arm having a rear end pivotally mounted on the frame for rotation about a first, horizontal axis, an opposite, forward end, and a locking device for selectively locking the lever arm at a selected orientation relative to the frame, a first pulley mounted on the lever arm at a location adjacent to the first pivot axis, a second pulley mounted on the lever arm at a location spaced from the pivot axis, and a cable having a first end linked to the resistance device and a second end extending over the first pulley and then over the second pulley to provide a take-off point for a selected exercise device adjacent the second pulley. The cable has a stop adjacent the second end for preventing the cable from pulling back over the second pulley when not in use.

By adjusting the orientation of the lever arm about the pivot axis, the height of the take-off point at which an exercise device such as a handle is secured to the second end of the cable can be adjusted. However, since the cable extends around the first pulley adjacent the pivot axis, adjustment of the orientation of the lever arm will not substantially change the cable tension.

In one embodiment of the invention, the support frame has a base and an upright member projecting upwardly from the base, and the lever arm is pivotally mounted on a swivel member on the base, the swivel member being rotatable about a vertical pivot axis and the swivel member being rotatable relative to the swivel member about a horizontal axis, so that it can be inclined upwardly for performing exercises in a standing position, and the inclination can be adjusted to accommodate different height users. The lever arm can be oriented horizontally for performing exercises in a sitting position on the floor.

In another embodiment of the invention, the lever arm is pivotally secured to the frame at a location behind the back rest, and the second end of the cable is secured to a handle for gripping by a user seated on the seat. The user may grip the handle in an overhead position when seated in a forward-facing direction, with the lever arm in an upwardly inclined orientation to provide an appropriate cable take-off position. The user then pulls forward on the cable against the resistance of the weight stack or the like. The actual orientation may be adjusted according to the height of the user. Alternatively, the lever arm may be oriented to provide a lower take-off point with the user gripping the handle in a rearward-facing position on the seat, to perform a different type of exercise.

The locking device preferably comprises a plate having a series of spaced holes extending along an arc centered on the pivot axis, and a pin for releasable engagement in a selected hole when the lever arm is in a selected orientation. In one embodiment, the plate is secured to the frame while the pin is secured to the lever arm. Alternatively, the plate may be secured to the lever arm and the pin may be secured at an appropriate position on the frame.

With this arrangement, the lever arm and thus the pulley can be oriented such that there will be no rolling of the cable stop over the pulley, regardless of the height of the user or the position in which they are performing exercises. Also, the lever arm can be oriented to adjust the height of the take-off point of connection to the exercise device, such that a tall person can perform exercises without the weight stack hitting the top of the frame. The lever arm can be tilted upwardly to the uppermost position for a tall person, so that the amount of cable they must pull out to perform an arm exercise, for example, is reduced, and available weight stack travel is increased.

In another embodiment of the invention, the lever arm is a support for a seat which pivots on an upright frame member to adjust the seat orientation from flat to inclined. In this case, the cable extends to a leg extension/leg curl exercise device at the forward end of the arm. The seat may be adjusted between the flat position for bench press and lat pull-down exercises, and an upwardly inclined position for leg extensions and seated leg curls. Such exercises require more space beneath the seat in order to allow the legs to swing freely beneath the seat while performing the exercise.

The lever arm of this invention is readily adjustable to accommodate different exercise positions and different height individuals, without changing cable tension significantly.

BRIEF DESCRIPTION OF THE DRAWINGS

The present invention will be better understood from the following detailed description of a preferred embodiment of the present invention, taken in conjunction with the accompanying drawings, in which like reference numerals refer to like parts, and in which.

DESCRIPTION OF THE PREFERRED EMBODIMENTS

Figure 1:
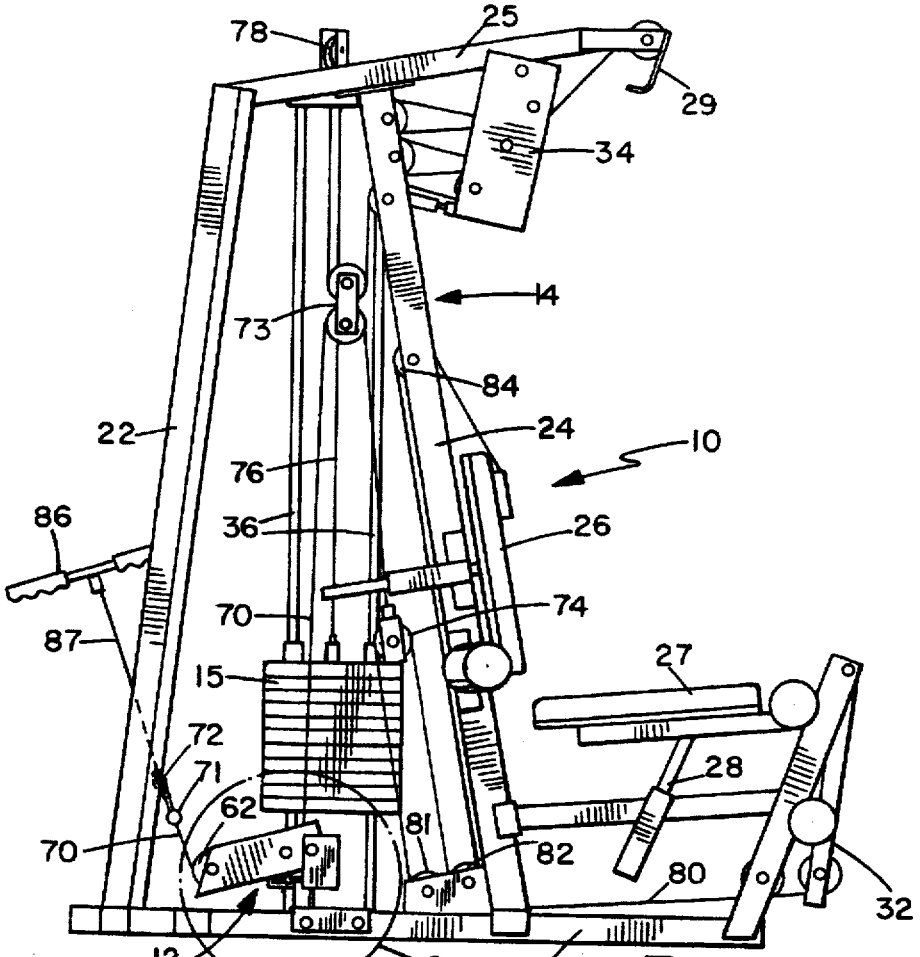
FIG. 1 is a side elevation view of an exercise machine incorporating an adjustable lever arm according to a first embodiment of the invention.

FIG. 1 illustrates an exercise apparatus 10 having a lever arm incorporated low swivel assembly 12 according to a first embodiment of the present invention, while FIGS. 2–5 illustrate the lever arm assembly in more detail. Exercise apparatus 10 basically comprises a support frame 14 on which weight stack 15 is slidably mounted and which has a series of exercise stations on which various exercises can be performed, as well as the low swivel assembly 12 which can be selectively attached to various types of add-on equipment or devices. Each exercise station as well as the add-on swivel assembly is linked to the weight stack via a cable and pulley system as will be explained in more detail below.

The support frame 14 has a base 20, rear upright struts 22, center upright strut 24, and top strut 25 extending forwardly across the top of the upright struts. Seat back pad 26 is adjustably mounted on upright strut 24, and seat base or bottom pad 27 is adjustably mounted on base 20 via telescopic support 28 in a conventional manner. The exercise stations include a pull down bar 29, a chest press bar (not illustrated), and leg extension assembly 32. Preferably, a range of motion device 34 is provided to link a press arm assembly to the weight stack, as described in my U.S. Pat. No. 5,236,406.

Weight stack 15 comprises a stack of rectangular weights which are slidably mounted on a pair of vertical guide rods 36 extending between the top and bottom or base of the frame. A transfer plate at the top of the stack has an adjustment rod (not illustrated) which extends downwardly from the plate through a series of aligned central openings in each weight or brick in the stack. The adjustment rod has spaced holes and each weight has a central aperture through which a retention peg (not illustrated) can be selectively inserted to engage an aligned hole in the adjustment rod, thus determining how many weights are linked to the transfer plate. A series of cables link the transfer plate to the pull down bar 29, chest press bar, leg extension assembly 32 and low swivel 12.

The low swivel assembly includes a swivel member 52 which is mounted on the base frame to pivot around a vertical pivot pin 42 or pivot axis into any desired exercise position. Additionally, the assembly includes a lever arm 44 which is pivotable about a horizontal axis between different inclined orientations relative to the base of the frame, to provide additional adjustment, as will be explained in more detail below. The low swivel assembly is illustrated in more detail in FIGS. 2–5. The assembly includes a mounting plate 40 mounted in a vertical orientation on swivel member 52, which in turn is rotatably mounted on pivot pin 42 on the base 20 of the frame. Lever arm 44 is rotatably mounted on plate 40 via pivot pin 46 which extends transverse to pivot pin 42. Pivot pin 42 is mounted on an angle bar or base mounting plate 43 which is secured to the base strut of frame 14 via bolts 45. A back plate 54 is also secured to the swivel member or sleeve 52 on the opposite side to plate 40 with the lever arm sandwiched between the two plates 40 and 54 at its rear end. Plates 40 and 54 have aligned holes 55,57, respectively, through which the pivot pin 46 extends. Lock nut 58 engages over the projecting threaded end 59 of pin 46 to secure the pin between the two plates.

Figure 3:
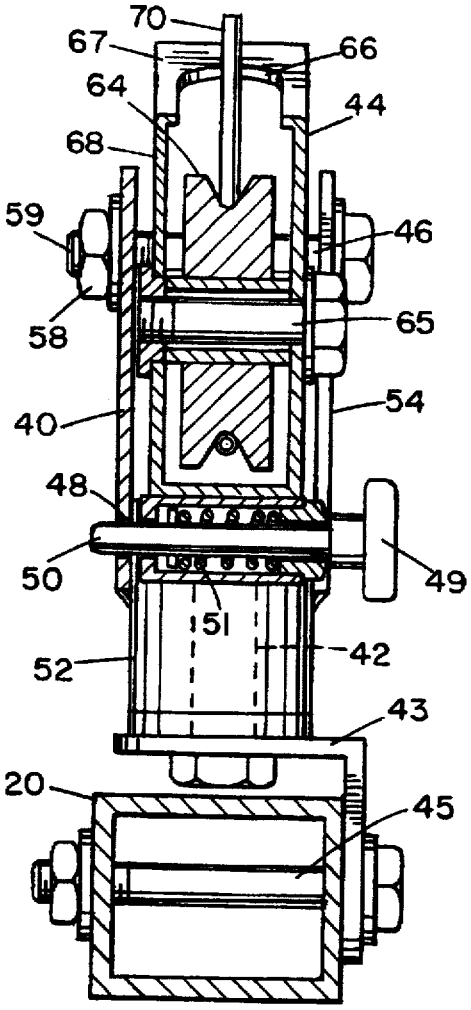
FIG. 3 is an enlarged sectional view taken on line 3—3 of FIG. 2.
Figure 4:
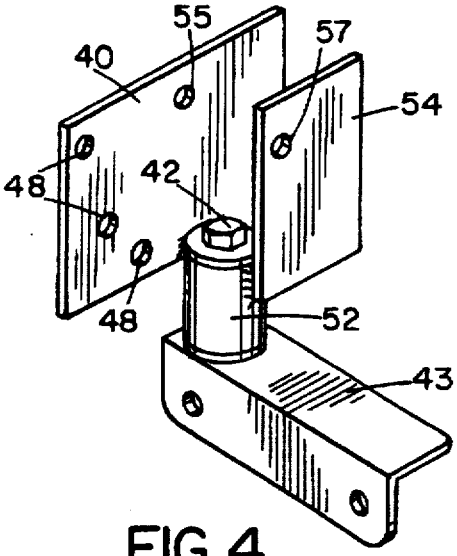
FIG. 4 is a perspective view of the swivel unit.
Figure 5:
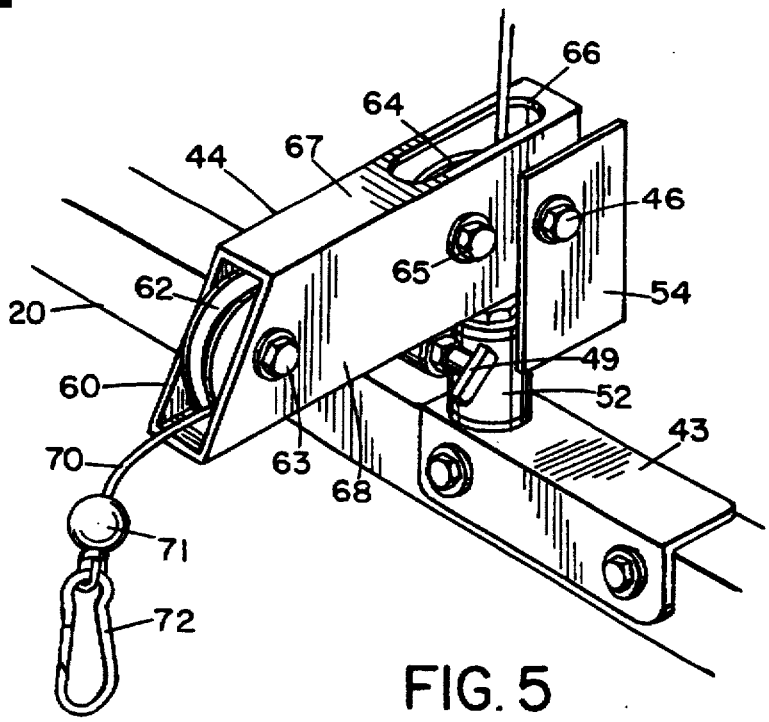
FIG. 5 is a perspective view of the complete lever arm structure.

The mounting plate 40 also has a series of at least three spaced adjustment holes 48 arranged on an arc centered on the pivot axis of pin 46. A spring-loaded dowel pin or peg 50 is mounted on lever arm 44, and will be biased outwardly by biasing spring 51 through an aligned hole 48 as illustrated in FIG. 3 when the lever arm 44 is in an appropriate inclined position. In order to adjust the orientation of lever arm 44, the user can simply pull back the peg 50 out of hole 48, using enlarged head 49 to grip the peg, and then rotate the lever arm about axis or pin 46 into the desired orientation in which the peg is aligned with another hole 48. The user then releases the peg and it is biased into the hole, fixing the orientation of the lever arm and preventing further rotation about pin 46.

The lever arm 44 comprises a generally rectangular housing having a tapered, open outer or forward end 60 in which a pulley 62 is rotatably mounted on pin 63, and a closed rear end in which a pulley 64 is rotatably mounted on pin 65. A slot or opening 66 is provided in the upper wall 67 of the housing above pulley 64. Pivot pin 46 extends through aligned holes in the side walls 68 of the housing with some clearance to allow rotation of the housing or lever arm about pin 46.

The low swivel is linked to the weight stack 15 via a suitable cable and pulley linkage. FIG. 1 illustrates one possible cable and pulley arrangement, but it will be understood by those skilled in the field that other alternative linkage arrangements may be provided. Cable 70 has a stop ball 71 and snap hook 72 at one end, and extends through the swivel housing around pulleys 62 and 64, and extends out through slot 66 and upwardly around the lower pulley of floating double pulley 73, and back down to floating single pulley 74. A cable 76 extends from the weight stack upwardly around a pulley 78 at the top of the frame, and then back down around the upper pulley of floating double pulley 73, and then out to the range of motion device 34. In this way, an exercise member secured to the snap hook 72 of the low swivel is linked to the weight stack.

Another cable 80 extends from the leg extension assembly 32 around pulley 81 at the base of the housing, up around floating pulley 74, back down around base pulley 82, and is secured to pulley 84.

Figure 2:
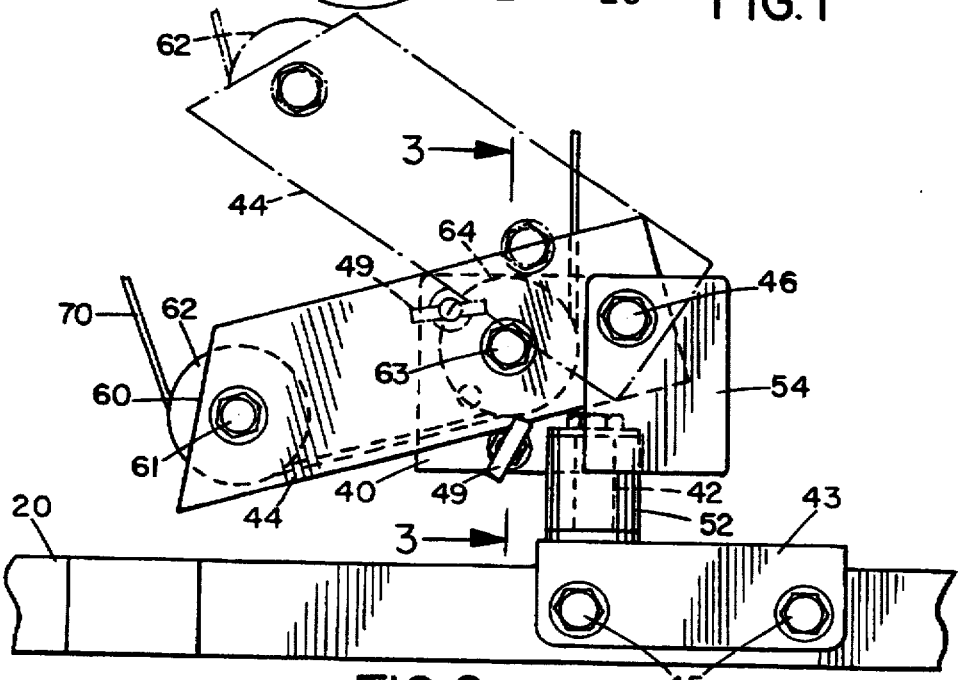
FIG. 2 is an enlargement of the lever arm circled in FIG. 1.

Different types of exercise attachments may be hooked onto snap hook 72 as desired for performing different types of exercise. For example, a crossbar handle 86 may be connected via chain 87 to the hook 72, and pulling exercises may be performed using the handle 86 from a standing or a sitting position. Cable 70 may also be linked to other, optional, add-on equipment such as a pectoral fly station, ankle bands, and so on. The orientation of the lever arm may be adjusted by the user pulling the pin 50 back from the opening 48, pivoting member 44 to the desired position, and then releasing the pin 50 so that it is biased into the new opening 48. FIG. 2 illustrates the lowermost and uppermost of the three possible positions of lever arm 44 permitted by the three openings 48 in plate 40. The uppermost, maximum tilt position is illustrated in dotted outline in FIG. 2. This allows adjustment of the cable take-off position for different height individuals, and for floor or standing exercises, for example. The lever arm would normally be placed in its lowermost position for exercises when seated on the floor, and in either of its two upwardly tilted positions for exercises in a standing position, dependent on the height of the user. Tilting of the lever arm will alter the equipment attachment point. Additionally, this adjustment will enable a tall person to perform exercises without the weight stack hitting the top of the frame before the user's arms have been moved to their full extent.

Another advantage of making the lever arm orientation adjustable is that the effect of the stop ball rolling over pulley 62 can be eliminated. If the lever arm 44 were fixed permanently in the lowermost position illustrated in FIG. 2, the stop ball will travel over the pulley surface a short distance as the cable is pulled out, which can be felt by the user. Also, this produces an undesirable kink in the cable, resulting in excessive wear. If the lever arm is angled upwardly when the cable must be oriented upwardly for connection to equipment, the ball is held clear of the pulley and this problem is avoided.

Figure 6:
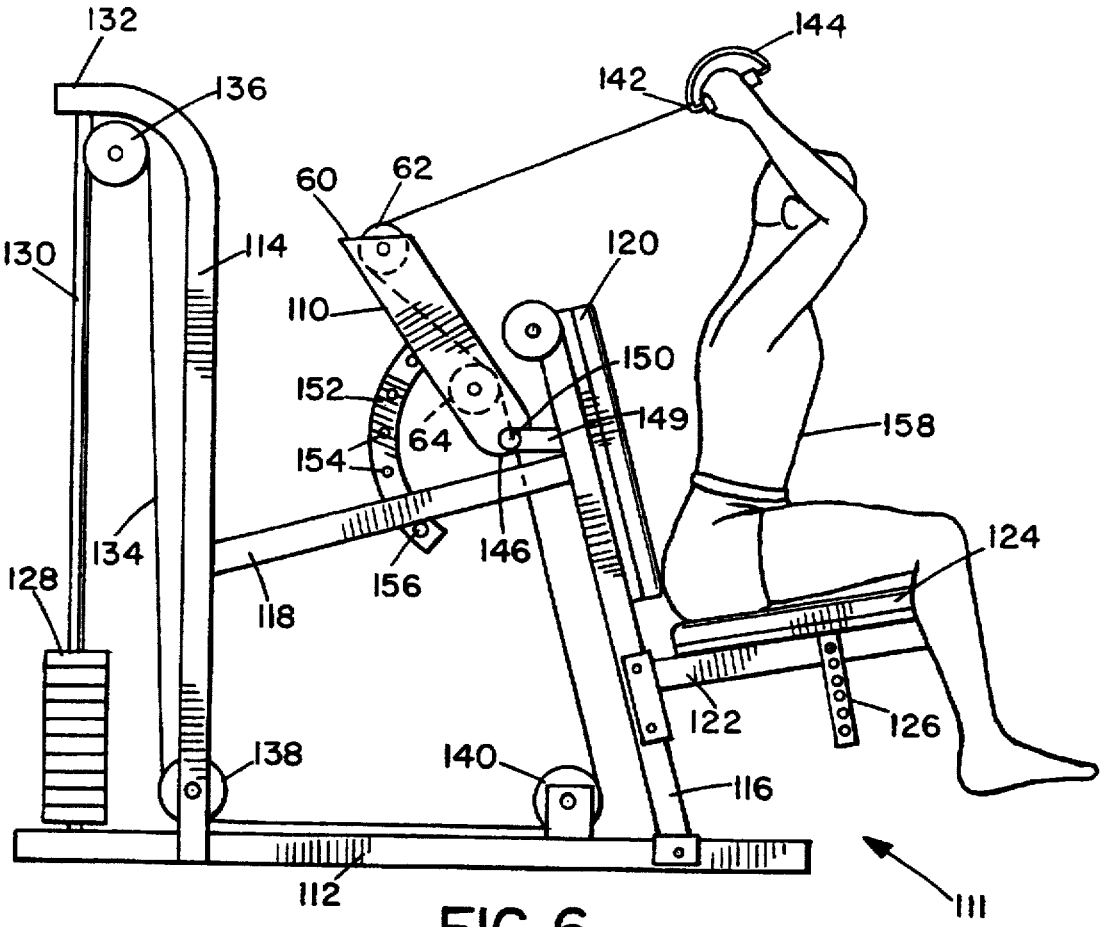
FIG. 6 is a side elevation view of an exercise machine incorporating an adjustable lever arm according to a second embodiment of the invention.
Figure 7:
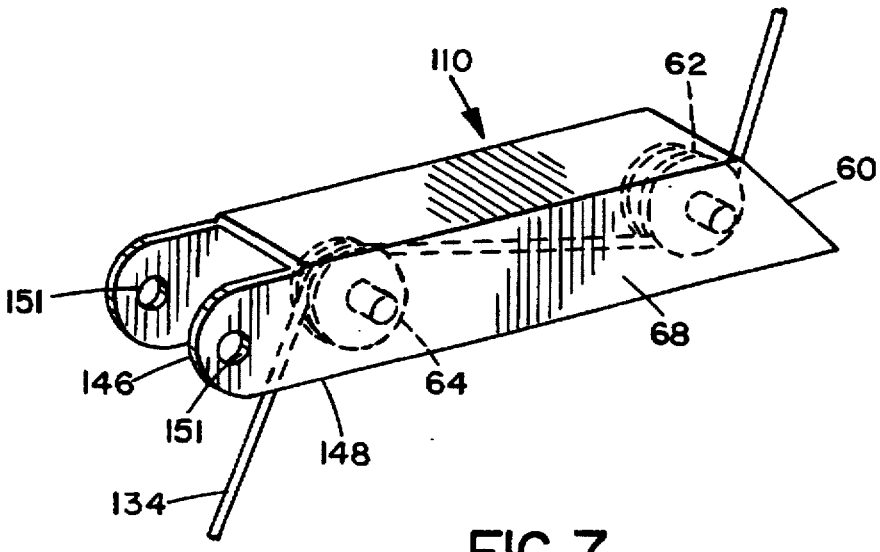
FIG. 7 is a perspective view of the lever arm from the rear.
Figure 8:
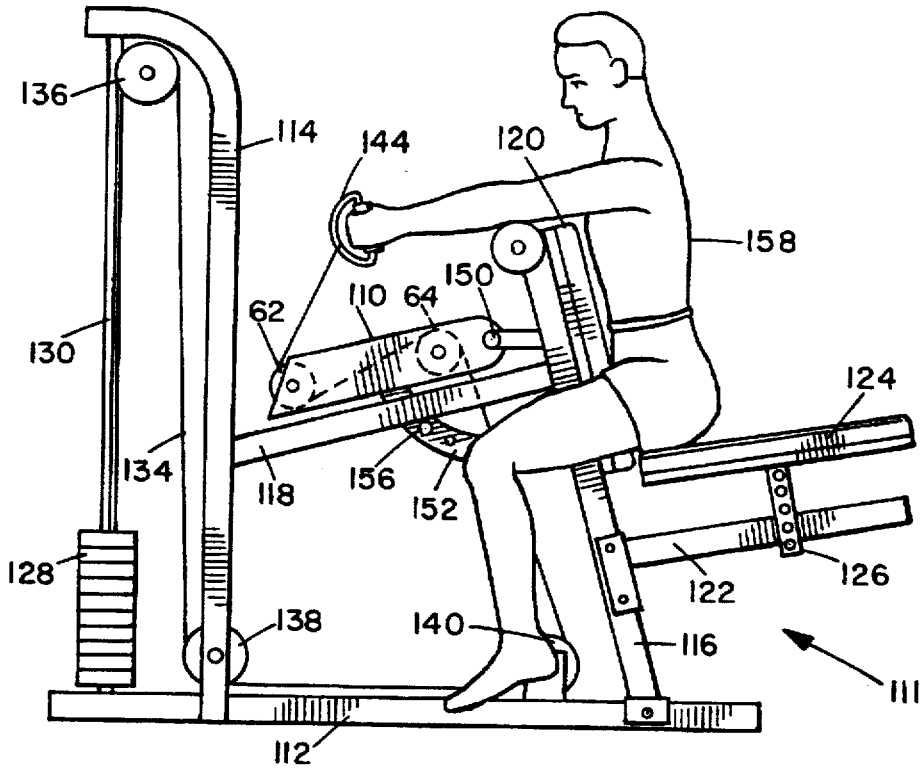
FIG. 8 is a side elevation view similar to FIG. 6, illustrating the lever arm in a different orientation for performing a different type of exercise.

FIGS. 6–8 illustrate another embodiment of the invention, in which a lever arm 110 is pivotally secured directly to the frame of an exercise machine 111, rather than via a swivel member at the base of the frame as in the previous embodiment. Apart from the cable and frame mounting, the lever arm 110 is otherwise identical to lever arm 44 of the previous embodiment, and like reference numerals have been used for like parts as appropriate.

In this embodiment of the invention, exercise machine 111 comprises a support frame having a base 112, rear upright strut 114, forward upright strut 116, and a connecting strut 118 between the rear and forward upright struts. A seat back rest or pad 120 is secured to the center upright strut and may be adjustable in the same manner as in the first embodiment. A seat support strut 122 projects outwardly from strut 116 to support seat pad 124, which is adjustable in height via a conventional adjustment device 126.

A weight stack 128 comprising a stack of rectangular weight blocks is slidably mounted on vertical guide rods 130 extending upwardly from the base of the frame to a rearwardly directed upper end portion 132 of the rear strut 114. A cable 134 is secured to the weight stack at one end and extends around pulley 136 at the top end of rear strut 114, pulley 138 at the lower end of rear strut 114, forward pulley 140 mounted on base 112, and upwardly around pulley 64 and pulley 62 of the lever arm 110. The second end 142 of the cable projects out of the open, forward end 60 of the lever arm housing, as in the previous embodiment. The second end 142 of the cable is secured to a handle 144 for gripping by a user when performing exercises.

In this embodiment, there is no low swivel member 52 and the rear end of the lever arm is pivoted directly to the forward upright strut at a location directly behind the backrest 120. The lever arm 110 itself is similar to that of the previous embodiment, and comprises a generally rectangular housing having a tapered, open outer or forward end 60 in which pulley 62 is rotatably mounted. Unlike the previous embodiment, the rear end 146 of the housing is rounded, and the housing is open at its rear end, with a lower end slot or opening 148 extending from the open rear end of the housing up to a location adjacent pulley 64, as best illustrated in FIG. 7. Pivot yoke or arms 149 project rearwardly from upright strut 116, and each arm is pivotally secured to one of two aligned pivot openings 151 in the opposite side walls 68 of the lever arm housing at a location adjacent the open rear end of the housing, defining a horizontal pivot axis 150.

Cable 134 extends upwardly from the forward pulley 140 on base member 112, and through the rear open end 146 of the housing for engagement around part of rearward pulley 64, and then extends forwardly inside the lever arm housing and around forward pulley 62 before extending out of the open forward end 60 of the housing. An arcuate adjustment plate 152 is secured at one end to the lever arm housing and projects downwardly from the housing in an arcuate path extending adjacent connecting strut 118. The arcuate plate 152 is centered on the pivot axis defined by pivot pin 150. A series of spaced holes 154 is provided along arcuate plate 152, and a retractable lock pin 156 is mounted on the connecting strut 118 at the point where arcuate plate 152 crosses the strut, as best illustrated in FIG. 6. The lock pin 156 is positioned at the same distance from pivot axis 150 as openings 154, such that each opening is aligned with pin 156 as it crosses the strut 118. Pin 156 may be pulled back into a retracted position clear of the plate to allow the lever arm to be rotated about pivot axis 150. Once the lever arm is in a desired orientation in which one of the holes 154 is aligned with pin 156, the pin is released and is spring biased into the aligned hole to lock the lever arm in position.

FIG. 6 illustrates arm 110 secured in a first position in which it is inclined upwardly at the maximum possible angle to a horizontal orientation, and the cable take-off point is at the highest possible position. In this orientation, the pin 156 will engage in the lowermost hole in arcuate plate 152. The lever arm will be oriented this way for use in an overhead pull exercise, in which the user 158 is seated in a forward facing position and grips the handle 144 with the arms over the head to pull forwards against the resistance of weight stack 128, in a tricep extension type of exercise. The same exercise can be performed readily by a shorter individual with the lever arm at a different angle to provide a lower cable take-off point from pulley 62.

FIG. 8 illustrates the lever arm 110 in its lowermost, substantially horizontal orientation. In this orientation, pin 156 engages in the uppermost hole in arcuate plate 152. Clearly, the pin 156 may be engaged alternatively in any of the other holes between the upper and lower holes to provide different arm orientations, depending on the type of exercise and user's body type. In the orientation of FIG. 8, the user is seated rearwardly and extends the arms towards the rear of the machine to grip the handle. They then pull the handle against the resistance of the weight stack in a mid row type of exercise.

Handle 144 may be a single hand grip member for gripping by both hands, or separate handles may each be secured to the second end 142 of the cable via separate lengths of cable or the like. Different exercises may be performed using handle 144, such as abdominal crunch exercises and the like.

With this arrangement, the tension in the cable will remain substantially the same regardless of the orientation of the lever arm 110. This is because the take-up point of the cable onto the lever arm at pulley 64 does not move to any great extent as the lever arm pivots about pivot axis 150, due to the positioning of pulley 64 adjacent pivot axis 150. The cable take-off point at the outer end of the lever arm, however, will move a substantial distance between the lowermost orientation of the arm in FIG. 8 and the uppermost orientation of FIG. 7, allowing a wide range of adjustment without changing the cable tension to any substantial extent.

Figure 9:
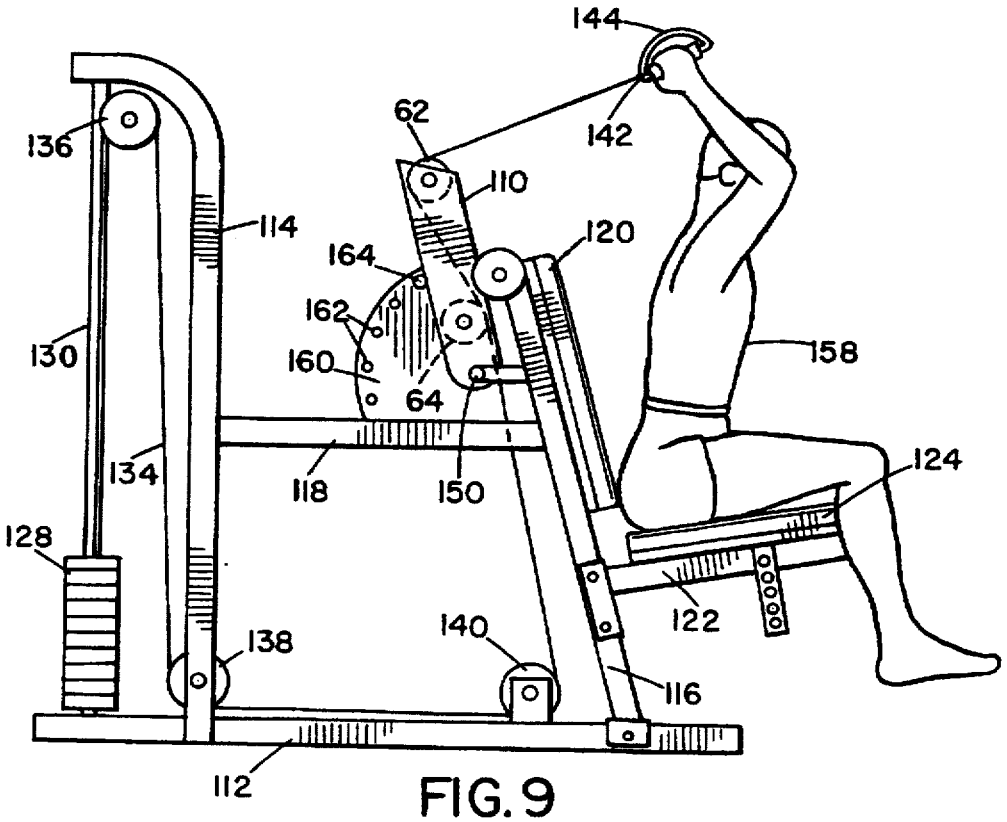
FIG. 9 is a side elevation view similar to FIG. 6, illustrating a modified lever arm locking assembly.

FIG. 9 illustrates a modified lever arm arrangement. The lever arm and lever arm mounting on the exercise frame are identical in this embodiment to the previous embodiment, and like reference numerals have been used for like parts as appropriate. However, the locking mechanism for releasably locking the lever arm 44 in a selected orientation is different. In this embodiment, a plate 160 is secured in a vertical orientation on connecting strut 118 to extend alongside the lever arm 110 throughout its range of motion. A series of spaced holes 162 extend in an arc on plate 160 which is centered at pivot axis 150. A releasable locking pin 164 is mounted on the lower wall of the lever arm housing, in a similar manner to locking pin 50 of the first embodiment, at the same distance from the pivot axis 150 as holes 162. Pin 164 may be moved into a retracted position clear of plate 160, and is biased by a spring into an extended position in which it extends through an aligned hole 162 in the plate 160.

This version may be used in exactly the same manner as that of FIGS. 6–8. The lever arm may be oriented in its uppermost position as illustrated in FIG. 9, with pin 164 extending through the uppermost hole 162 in plate 160 to secure the arm in position, in order to perform an overhead, triceps extension exercise. For a shorter individual, the lever arm may be lowered into another orientation with the pin extending through one of the other openings. Alternatively, the lever arm may be rotated in a counterclockwise direction from the position illustrated in FIG. 9 into a lowermost position in which it is substantially horizontal, as in FIG. 8 of the previous embodiment. In this case the pin 164 extends through the lowermost hole in plate 160 and the user may face rearwardly to perform a mid-row type of exercise.

Although the lever arm is provided on a different type of exercise machine in the embodiments of FIGS. 6–9 from that of FIGS. 1–5, in which there is only one exercise station rather than several, the lever arm 110 may alternatively be pivoted to the front upright 24 of FIG. 1 in another embodiment. Thus, a lever arm 110 may be pivoted behind the back rest 26 of the machine of FIG. 1 in addition to the lever arm 44 pivoted to the low swivel 52, in exactly the same manner as the lever arm 110 in FIGS. 5–9. In this alternative, a connecting strut will be provided between uprights 22 and 24 to provide a mounting point for a lock pin as in FIGS. 6–8 or a plate as in FIG. 9. The other end of cable 80 may extend around the pulleys on the second lever arm, rather than secure to the pulley 84 as in FIG. 1. Other cable connection points may be provided as needed by means of double floating pulleys, in the manner known in the field.

Figure 10:
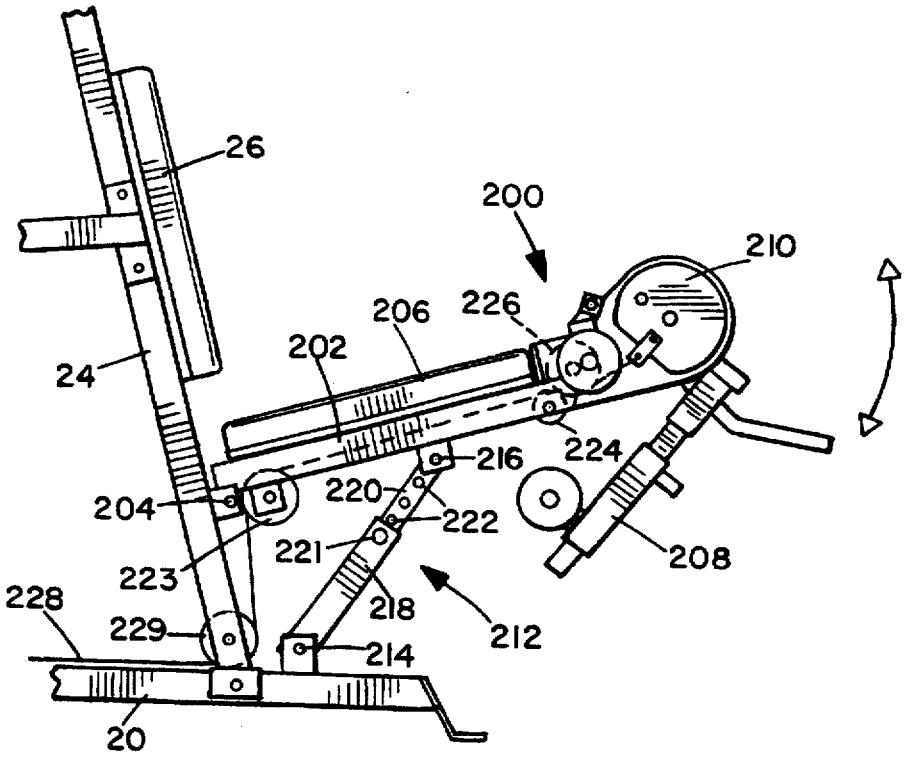
FIG. 10 is an enlargement of the seat portion and upright strut of an exercise machine similar to FIG. 1, illustrating an adjustable arm according to a third embodiment of the invention.
Figure 11:
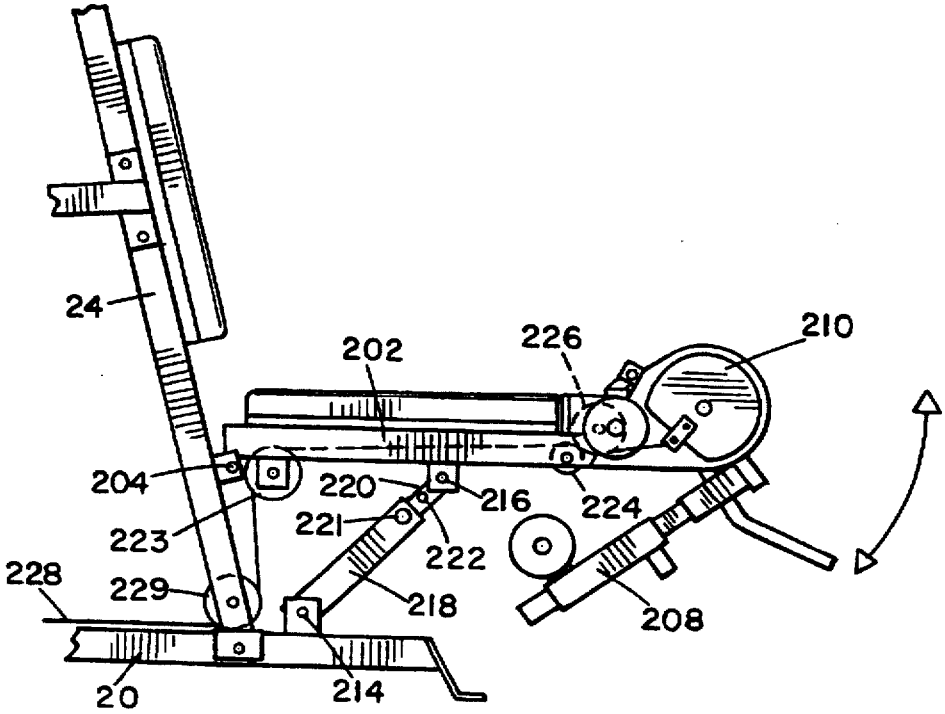
FIG. 11 is a view similar to FIG. 10 illustrating the arm in a different position.

FIGS. 10 and 11 illustrate an adjustable lever arm assembly 200 according to a third embodiment of the invention. The remainder of the exercise machine may be similar to that of FIG. 1, or the assembly 200 may be installed in place of an existing seat assembly on any exercise machine. In this embodiment, a lever arm 202 is pivoted via pivot pin 204 at its rear end to the upright strut 24 of the exercise machine frame, and a seat pad 206 is supported on the arm 202. A leg exercise member 208 for performing leg extension and leg curl exercises is mounted at the forward end of lever arm 202 via bidirectional pulley 210.

A telescoping adjustment assembly 212 is secured between a lower or base strut 20 of the machine frame and the lower side of lever arm 202 via pivots 214, 216, respectively. The assembly 212 comprises a sleeve member 218 and a telescoping pin or shaft 220 projecting out of the open end of sleeve member 218. A locking pin 221 extends through the open end of the sleeve member through a selected aligned hole 222 in telescoping shaft 220 to lock the shaft 220 in any desired position. The combined length of the sleeve and telescoping shaft can be readily adjusted, thereby adjusting the angular orientation of the lever arm 202, and thus the angle of the seat pad 206, between a flat, horizontal orientation as illustrated in FIG. 11 and an upwardly inclined orientation as illustrated in FIG. 10.

Lever arm 202 has a first pulley 223 at its rear, pivoted end and a pair of pulleys 224,226 rotatably mounted at its forward end. A load-bearing cable 228 extends around a pulley 229 at the lower end of the upright strut, around pulleys 223,224 and 226, and is tied to the bidirectional pulley 210 at the forward end of the lever arm. Lever arm 202 is preferably a channel member similar to the lever arm 110 of the previous embodiment, so that the pulleys 223,224 and 226 are all mounted at least partially within the downwardly facing channel of arm 202 and between the opposite side walls of the channel, as indicated in FIGS. 10 and 11.

With this arrangement, the seat pad 206 can be readily adjusted between a horizontal or flat orientation as in FIG. 11 and an upwardly inclined orientation as in FIG. 10, simply by pulling out locking pin 221 and pulling the seat upwardly to the desired position before reinserting the locking pin 221 through the sleeve 218 and the aligned hole 222 in shaft 220. In the upwardly inclined position of FIG. 10, there will be more space below the seat, allowing room for a seated user's legs to swing freely underneath the seat while performing leg extension and leg curl exercises using the leg exercise arm 208. In the flat or horizontal position of FIG. 11, the user can perform bench press or lat pull-down exercises, and has easier access to the machine. The lever arm assembly allows the seat position to be adjusted without changing the cable tension.

The adjustable lever arm of each of the above embodiments may be readily adjusted to change the height of a cable take-off point from the lever arm at which the cable is secured to an exercise device or handle. The location of the cable take-up point on the lever arm remains substantially unchanged as the lever arm is rotated, so that little or no change in cable tension is produced as the lever arm is rotated to a new position.

Although some preferred embodiments of the invention have been described above by way of example only, it will be understood by those skilled in the field that modifications may be made to the disclosed embodiments without departing from the scope of the invention, which is defined by the appended claims.

I claim:

1. Exercise apparatus, comprising:

a vertical support frame;

resistance means on said frame for providing resistance to exercises performed on said apparatus;

an elongate lever arm having a rear end pivotally mounted on said frame for rotation about a first, horizontal axis, and a forward end spaced outwardly from said rear end;

releasable locking means for releasably locking said lever arm in a selected orientation about said first axis;

a first pulley attached to said lever arm for rotation about a second axis adjacent said rear end parallel to and spaced forwardly from said first axis and a second pulley attached to said lever arm adjacent the forward end of said lever arm; and a cable having a first end linked to said resistance means and a second end, the second end of said cable extending first around at least part of said first pulley and then around at least part of said second pulley for attachment to an exercise device or tie-off.

2. The apparatus as claimed in claim 1, including an exercise device comprising a handle attached to the second end of said cable adjacent said second pulley, whereby adjustment of the orientation of said lever arm adjusts the height of a take-off position for performing different exercises.

3. The apparatus as claimed in claim 1, wherein said releasable locking means comprises a first member comprising a plate having a series of spaced holes at spaced intervals along an arc centered on said first axis and a second member comprising a pin for releasable engagement in a selected one of said holes, one of said members being mounted on said lever arm and the other member being mounted on said frame, whereby engagement of said pin in a selected hole in said plate releasably locks said lever arm in a selected orientation relative to said frame.

4. The apparatus as claimed in claim 3, wherein said pin is mounted on said lever arm and said plate is secured to said frame.

5. The apparatus as claimed in claim 4, wherein said plate is mounted on said lever arm and said pin is secured to said frame.

6. The apparatus as claimed in claim 1, wherein said lever arm comprises a substantially rectangular housing having an upper wall, a lower wall, spaced side walls, a rear end and a forward end, said housing having aligned pivot openings in said side walls adjacent the rear end of said housing, and pivot means mounted on said frame and pivotally secured to said aligned pivot openings for pivotally connecting said housing to said frame.

7. The apparatus as claimed in claim 6, wherein said lever arm has an open forward end, and said second pulley is mounted in said housing and projects partially out of said open end.

8. The apparatus as claimed in claim 7, wherein said first pulley is mounted in said housing adjacent said rear end, said housing upper wall having an opening above said first pulley, and said second end of the cable extending downwardly through said opening and around part of said first pulley and then around said second pulley, and out through the open forward end of said housing.

9. The apparatus as claimed in claim 7, wherein said first pulley is mounted in said housing adjacent said rear end, said housing lower wall having an opening below said first pulley, and said second end of the cable extending upwardly through said opening and around part of said first pulley and then around said second pulley, and out through the open forward end of said housing.

10. The apparatus as claimed in claim 1, including a seat mounted on said support frame, the frame including an upright member and the seat having a back rest secured to the upright member to face in a forward direction from said frame, and the lever arm is pivotally secured to said upright member at a location behind said back rest.

11. The apparatus as claimed in claim 1, including a mounting member rotatably mounted on said frame for rotation about a second axis perpendicular to said first axis, the second end of the lever arm being pivotally secured to said mounting member for rotation about said first axis, whereby the orientation of said first, pivot axis is adjustable by rotation of said mounting member about said second axis.

12. The apparatus as claimed in claim 11, wherein said releasable locking means comprises a plate mounted on said mounting member, said plate having a series of spaced holes, and a locking pin mounted on said lever arm and movable between a retracted position and an extended position extending through an aligned hole in said plate to lock said lever arm in a selected orientation.

13. The apparatus as claimed in claim 1, including a bidirectional pulley attached to the second end of said cable adjacent said second pulley, and an exercise device secured to said pulley.

14. The apparatus as claimed in claim 13, wherein said exercise device comprises leg extension/leg curl exercise means for performing seated leg extension and leg curl exercises.

15. The apparatus as claimed in claim 1, including a seat pad secured to the lever arm for supporting a seated user, whereby said seat pad may be adjusted into selected horizontal or upwardly inclined orientations by adjustment of said lever arm.

16. The apparatus as claimed in claim 15, wherein said vertical support frame includes an upright strut and a base strut, the rear end of said lever arm being pivotally mounted on said upright strut, and said releasable locking means comprises an adjustment assembly of adjustable length secured between said base strut and lever arm.

* * * * *